US007607925B2

(12) United States Patent
Chuang

(10) Patent No.: US 7,607,925 B2
(45) Date of Patent: Oct. 27, 2009

(54) DISPLAYPORT HAVING PROTECTION CIRCUIT

(76) Inventor: Yi-Fang Chuang, 5F., No. 15, Lane 117, Sec. 4, Sanha Rd., Sanchong City, Taipei County 241 (TW)

( * ) Notice: Subject to any disclaimer, the term of this patent is extended or adjusted under 35 U.S.C. 154(b) by 0 days.

(21) Appl. No.: 12/178,736

(22) Filed: Jul. 24, 2008

(65) Prior Publication Data

US 2009/0027378 A1 Jan. 29, 2009

(30) Foreign Application Priority Data

Jul. 24, 2007 (TW) ..... 96212090 U

(51) Int. Cl.
*H01R 12/00* (2006.01)

(52) U.S. Cl. ..... 439/79; 439/620.08

(58) Field of Classification Search ..... 439/78, 439/79, 607.4, 620.01, 620.05–620.08
See application file for complete search history.

(56) References Cited

U.S. PATENT DOCUMENTS 6,556,411 B1 * 4/2003 Hoeft et al. ..... 361/119
6,821,153 B2 * 11/2004 Otto et al. ..... 439/620.08
6,860,762 B2 * 3/2005 Spykerman et al. .... 439/620.08
7,306,468 B2 * 12/2007 Baker ..... 439/76.1

* cited by examiner

*Primary Examiner*—Khiem Nguyen
(74) *Attorney, Agent, or Firm*—Chun-Ming Shih

(57) ABSTRACT

A DisplayPort having protection circuit includes a supporting seat, a first terminal set, a circuit board, a second terminal set, a bottom plate and an outer casing. The supporting seat has a main body, at front of which a sealing wall is arranged. A supporting piece is extended outwardly from the sealing wall. A plurality of perforations are arranged at the supporting place between the supporting piece and the sealing wall. The first terminal set passes through the perforations and is disposed on the supporting piece. The circuit board placed in the supporting seat is electrically connected to the first terminal set. At least one protecting element is electrically connected onto the circuit board. The second terminal set is electrically connected to the circuit board. The bottom plate is assembled to the bottom part of the supporting seat. The outer casing has a hollow main body, at front of which a plugging opening is arranged. The outer casing is externally assembled and connected to the supporting seat, making the supporting piece of the supporting seat located in the plugging opening. When there is high current or surge entering the DisplayPort, the protection element can sequester the high current or surge, ensuring certain electronic parts in the circuit board without damage.

16 Claims, 5 Drawing Sheets

DISPLAYPORT HAVING PROTECTION CIRCUIT

BACKGROUND OF THE INVENTION

1. Field of the Invention

The present invention generally relates to a port, in particular, to a DisplayPort having high speed and high definition.

2. Description of Prior Art

Video Electronics Standard Association (VESA) has formally validated a new generation of digital image transmitting interface—"DisplayPort"—joining as a support for High-Bandwidth Digital Content Protection (HDCP) to meet the requirement for playing a high definition VCD, such as, Blue-ray disk (BD) and high definition (HD) DVDs.

DisplayPort, a new generation of digital image transmitting interface, is regulated by VESA for the products of personal computer (PC) and digital appliances. DisplayPort may replace the existing PC image transmitting interfaces, for example, low voltage differential signaling (LVDS), Digital Video Interactive (DVI) and Video Graphics Array (VGA), providing the internal/external transmitting functions of high-bandwidth digital images (and sound effects).

DisplayPort applies external connector of small size that is easily plugged in and pulled out and is close to a connector size of standard USB. In the meantime, DisplayPort adopts 8B/10B code and is embedded with clock signal and micro-package configuration, so DisplayPort is capable of reducing electromagnetic interference and provides a highest transmitting bandwidth of 10.8 Bbps, which is higher than that of existing DVI interface. DisplayPort is a direct and flexible image transmitting disposition and also supports the functions of digital sound effect transmission, bidirectional auxiliary data transmission and digital content encryption.

In regard to digital content encryption, an independent DPCP (DisplayPort Content Protection) specification is adopted, which can meet the requirement for playing blue-ray laser high resolution VCD, for example, BD or HD DVD, making device adopted DisplayPort possess the function of digital high definition video output played by BD or HD DVD.

Although DisplayPort has aforementioned functions, when DisplayPort undergoes video signal transmission with external video device through transmission line, if external video device has abnormal operation, thunder hit or improperly plugging in and pulling out of terminal, through DisplayPort, the generated high current or surge signal will be transmitted to the circuit board that is electrically connected to DisplayPort, and the instantly generated high current or surge signal (spark) can easily cause damage to some components on main circuit board.

Accordingly, aiming to solve aforementioned shortcomings, after a substantially devoted study, in cooperation with the application of relatively academic principles, the inventor has at last proposed the present invention that is designed reasonably to possess the capability to improve the prior arts significantly.

SUMMARY OF THE INVENTION

The invention is mainly to provide a DisplayPort internally arranged a protection circuit to solve the drawbacks of traditional DisplayPort. When external video device has abnormal operation, thunder hit or improperly plugging in and pulling out of terminals, the protection circuit will sequester the generated high current or surge signals, keeping them from entering the circuit board that is electrically connected to DisplayPort. Thus, causing damage to some electronic parts of the circuit board can be avoided.

Secondly, the invention is to provide a DisplayPort having protection circuit, including a supporting seat, a first terminal set, a circuit board, a second terminal set, a bottom plate and an outer casing. The supporting seat has a main body arranged thereon, at front of which there is a sealing wall that is extended outwardly a supporting piece and a base plate. A plurality of grooves are respectively arranged on upper and lower faces of the supporting piece. A plurality of perforations that are communicated to an internal accommodating space of the main body are arranged at a supporting place between the grooves and the sealing wall. The first terminal set consists of a plurality of connecting legs, each of which has a front connecting leg and a rear connecting leg. After passing through the perforation, the front connecting leg is fixedly plugged in the groove. On the circuit board, at least one protection element is electrically connected. The function of the protection element is to avoid instantly high current or surge signal from entering the electronic device. A plurality of perforations are arranged at one side of the circuit board. Rear connecting leg passes through the perforation and is electrically connected to the circuit board. Another side of the circuit board has a plurality of electrode connecting legs. The second terminal set consists of a plurality of connecting legs, each of which has a front connecting leg and a rear connecting leg. The front connecting leg is electrically connected to the electrode connecting leg of the circuit board. A set of plate part assembled to the bottom part of the supporting seat is arranged on the bottom plate. One side of the plate part is bent into a stop part that is assembled to a back opening of the sealing seat. In addition, a perforation is arranged at the connecting place between the plate part and stop part. The perforation is to provide the rear connecting leg of the second terminal to pass through. The outer casing has a hollow main body, at front of which there is a pluggin opening, a peripheral of which supports a plurality of arc stopping pieces. A stopping piece is respectively arranged at end sides of the rear side and the side face of the hollow main body. When the supporting seat is assembled into the main body, the stopping pieces can prevent the supporting seat from coming off. In the meantime, a set of connecting legs are extended from the bottom part of the side face of the main body. The connecting legs are to provide electrical connection and fixed combination between the main body and the main circuit board of the electronic device.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

In cooperation with attached drawings, the technical contents and detailed description of the present invention are described thereinafter according to a preferable embodiment, being not used to limit its executing scope. Any equivalent variation and modification made according to appended claims is all covered by the claims claimed by the present invention.

Figure 1:
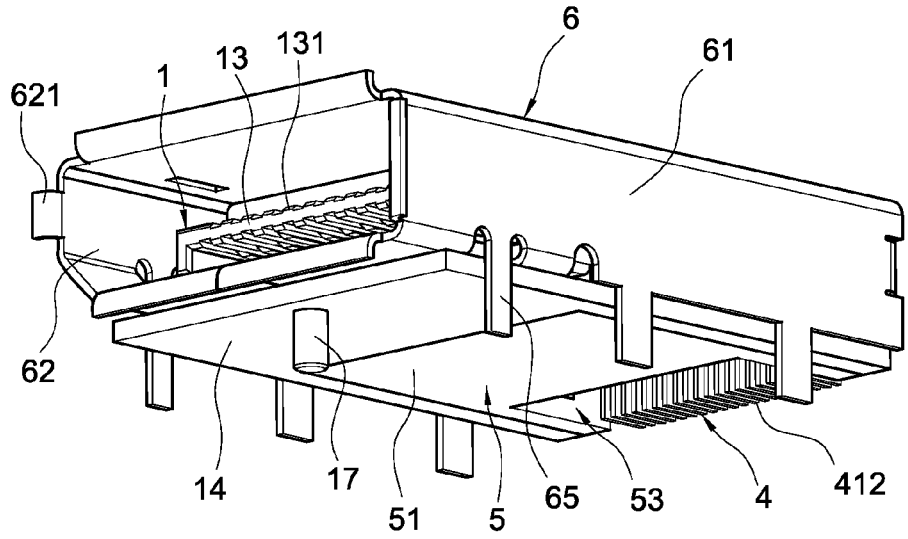
FIG. 1 is a perspective view of the outer appearance of the DisplayPort of the present invention.
Figure 2:
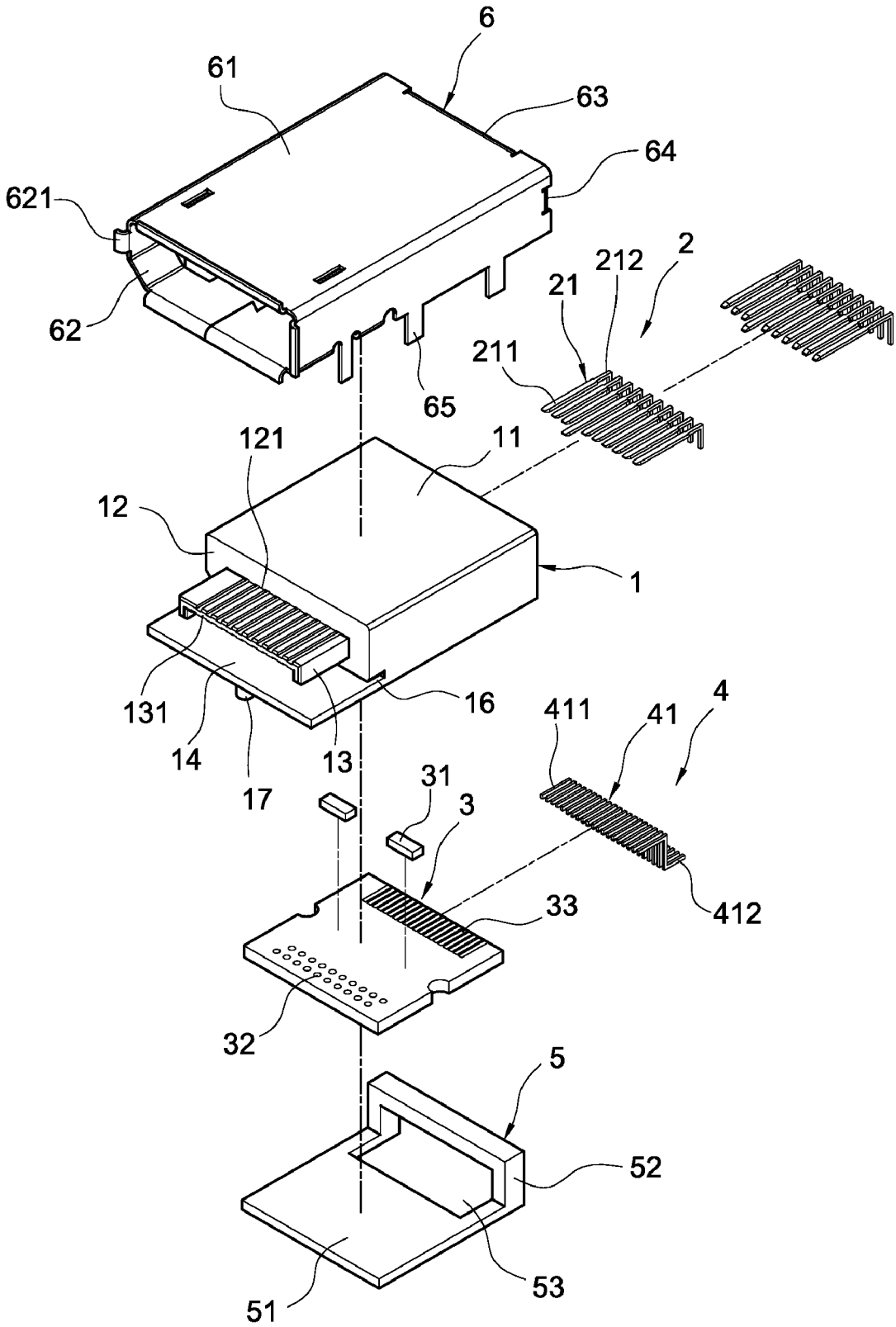
FIG. 2 is an explosive illustration of the DisplayPort of the present invention.
Figure 3:
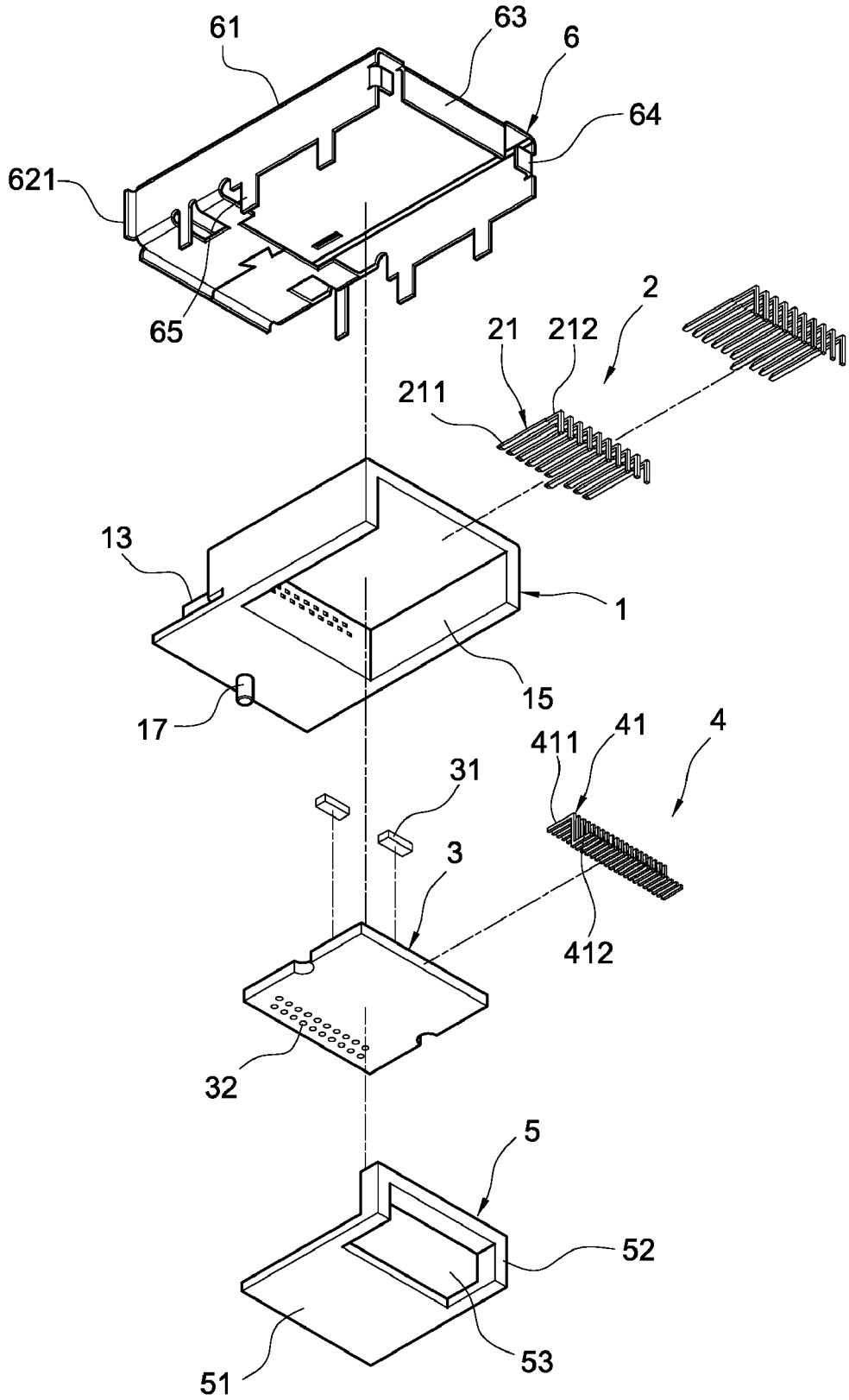
FIG. 3 is an explosive illustration, viewed from another angle, of the DisplayPort of the present invention.

Please refer to FIG. 1 through FIG. 3, which respectively are an outer appearance of perspective illustration, an explosive illustration and an explosive illustration viewed from another angle of the DisplayPort according to the present invention. As shown in these figures, the DisplayPort having protection circuit of the present invention includes a supporting seat 1, a first terminal set 2, a circuit board 3, a second terminal set 4, a bottom plate 5, and an outer casing 6.

According to a preferable embodiment of the present invention, the supporting seat 1 is made of insulating material, on which there is a main body 11. A sealing wall 12 is arranged at front of the main body 11. The sealing wall 12 is extended outwardly a supporting piece 13 and a base plate 14. A plurality of grooves 131 are arranged respectively on upper and lower faces of the supporting piece 13. A plurality of perforations 121 are arranged at the supporting place between the grooves 131 and the sealing wall 12. The perforation 121 communicated to an internal accommodating space 15 is to provide a front connecting leg 212 of the first terminal set 2 to pass through the perforation 121 via the accommodating space 15 and then to be fixedly plugged in the groove 131. In addition, a gap 16 is arranged between the sealing wall 12 and the base plate 14. The gap 16 is to provide an end side of the bottom part of the outer casing 6 to be inserted into. Furthermore, a projective pillar 17 is supported against the back face of the base plate 14 to provide the connector to be fixed on the circuit board (not shown in the figures).

The first terminal set 2 consists of a plurality of connecting legs 21 respectively shown as an "L" letter. The connecting leg 21 has a front connecting leg 211, at rear side of which a rear connecting leg 212 is extended and bent into 90 degrees. After passing through the perforation 121, the front fixing let 211 is fixedly plugged in the groove 131.

In regard to the circuit board 3, at least one protection circuit 31 protecting the IC is electrically connected thereto. The function of the protection circuit 31 is to prevent instantly high current or surge signal from entering the electronic device (not shown in the figures). Thus, burning down the electronic components on the circuit board of the electronic device can be avoided. In addition, a plurality of perforations 32 are arranged at one side of the circuit board 3. The perforation 32 provides the rear connecting leg 212 of the connecting leg 21 to pass through, making the rear connecting leg 212 electrically connected to the circuit board 3. Another side of the circuit board 3 has a plurality of electrode connecting legs 33, each of which is electrically connected to the second terminal set 4.

The second terminal set 4 consists of a plurality of connecting legs 41, each of which is shown as a stairs shape. The front connecting leg 411 of the connecting leg 41 is electrically connected to the electrode connecting leg 33 of the circuit board 3, while the rear connecting leg 412 is electrically connected to an external circuit board (not shown in the figures).

The bottom plate 5 made of insulating material is shown as an "L" shape, on which a plate part 51 is assembled to the bottom part of the supporting seat 1. One side of the plate part 51 is bent into a stop part 52 assembled to an opening at back of the supporting seat 1. Moreover, a perforation 53 is arranged at the connecting place between the plate part 51 and the stop part 52 to provide the rear connecting legs 412 of the second terminal set 4 to pass through.

The outer casing 6 made of metallic material has a hollow main body 61, at front of which there is a plugging opening 62 provided for the connecting terminal of transmission line (not shown in the figures) to be plugged therein. Opening periphery of the plugging opening 62 is supported by a plurality of arc stopping pieces 62. In addition, stopping pieces 63, 64 are respectively arranged at end sides of the rear side and the side face of the hollow main body 61. When the supporting seat 1 is assembled into the main body 61, the stopping pieces 63, 64 can prevent the supporting seat 1 from coming off. Again, a set of connecting legs 65 are extended from the bottom part of a side face of the main body 61 to provide the main body 61 electrically connected to or fixedly combined with the main circuit board of an electronic device (not shown in the figures).

Figure 4:
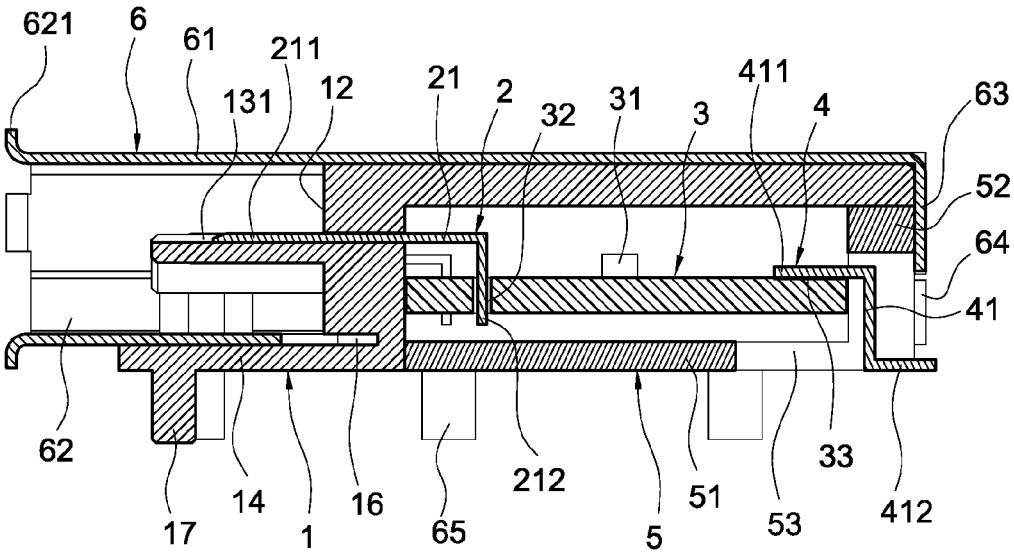
FIG. 4 is an assembled and cross-sectional view of the DisplayPort of the present invention.

Please refer to FIG. 4, which is an assembled and cross-sectional illustration of the DisplayPort of the present invention. As shown in this figure, when the DisplayPort is assembled, the front connecting legs 211 are plugged into the grooves 131 of the supporting piece 13, after the front connecting legs 211 of the first terminal set 2 pass through the perforations 121. The rear connecting legs 212 of the connecting legs 21 pass through the perforations 32 of the circuit board 3 and are electrically connected to the circuit board 3. The electrode connecting legs 33 arranged on the circuit board 3 are electrically connected to the front connecting legs 411 of the second terminal set 4. Furthermore, an insulating bottom plate 5 is assembled to the bottom part of the supporting seat 1. Next, the rear connecting legs 412 of the second terminal set 4 pass through the perforations 53 of the insulating bottom plate 5, while the stop part 52 of the insulating bottom plate 5 is located at the opening at back side of the supporting seat 1.

When the supporting seat 1, the first terminal set 2, the circuit board 3, the second terminal set 4 and the insulating bottom plate 5 are assembled completely, the assembly will be further assembled into the outer casing 6, first making the supporting piece 13 at front of the supporting seat 1 extended into the plugging opening 62, then making the bottom part of the plugging opening 62 inserted into the gap 16, after the stopping pieces 53, 54 at rear side and side face of the outer casing 6 being bent, the supporting seat 1 being thus assembled in the outer casing 6.

Figure 5:
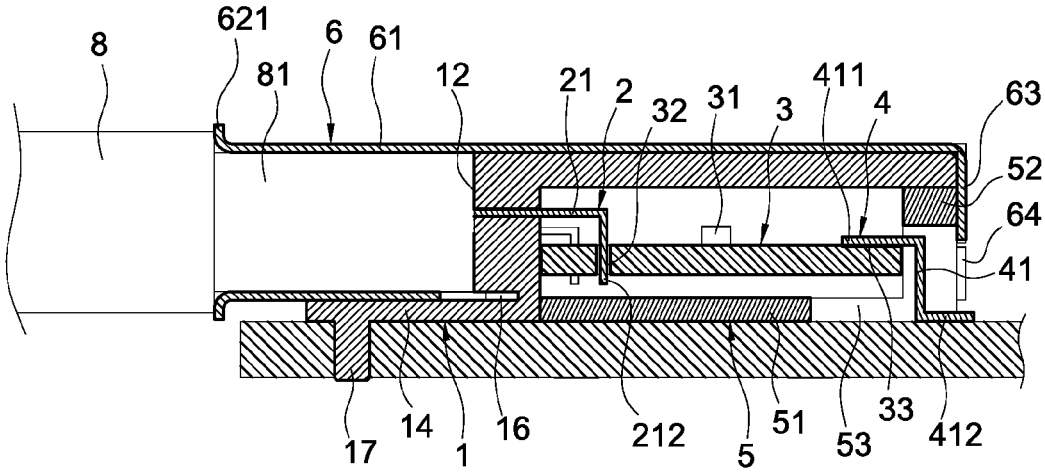
FIG. 5 is a using status illustration of the DisplayPort of the present invention.

Please refer to FIG. 5, which is a using status illustration of the DisplayPort of the invention. As shown in this figure, when using the DisplayPort of the invention, the rear connecting legs 412, of the second terminal set 4, externally extended from the DisplayPort, are electrically connected to the circuit board 7. After the plug 81 of an image display transmitting line 8 is plugged in via the plugging opening 62 and is electrically contacted with the first terminal 2, video signals are transmitted to the circuit board 3 and are further transmitted to the circuit board 7 via the second terminal set 4 of the circuit board 3. Thereby, video signals from external device can be transmitted to the circuit board 7 of an intended device and processed therein.

When external video device has abnormal operation or is hit by thunder, the generated high current or surge signal is transmitted to the circuit board 3 via the first terminal set 2.

However, since the protection element 31 on the circuit board 3 makes the circuit shown as a status of open circuit, the high current or surge signal is prevented from transmitting to the circuit board 7 of the intended device. Thus, causing damage to the circuit board 7 can be avoided.

According to the aforementioned structure, a DisplayPort having protection circuit of the present invention is thereby obtained.

Summarizing aforementioned description, the invention is an indispensably novel structure for a DisplayPort indeed, which may positively reach the expected usage objective for solving the drawbacks of the prior arts, and which extremely possesses the innovation and progressiveness to completely fulfill the applying merits of new type patent, according to which the invention is thereby applied. Please examine the application carefully and grant it as a formal patent for protecting the rights of the inventor.

However, the aforementioned description is only a preferable embodiment according to the present invention, being not used to limit the patent scope of the invention, so equivalently structural variation made to the contents of the present invention, for example, description and drawings, is all covered by the claims claimed thereinafter.

What is claimed is:

1. A DisplayPort having protection circuit, including:

a supporting seat, on which there is a main body, at a front of which a sealing wall is arranged and is extended outwardly a supporting piece and a base plate, an upper face and a lower face of the supporting piece being respectively arranged a plurality of grooves, meanwhile, a plurality of perforations communicated to an accommodating space arranged in the main body being arranged at a supporting place between the grooves and the sealing wall;

a first terminal set, which is disposed in the grooves by passing through the perforations from the accommodating space;

a circuit board, which is disposed in the accommodating space and is electrically connected to the first terminal set, and on which at least one protection element is electrically connected;

a second terminal set, which is electrically connected to the circuit board;

a bottom plate, which is assembled to a bottom part of the supporting seat; and an outer casing, which has a hollow main body, at a front of which a plugging opening is arranged, and which is externally assembled to the supporting seat, making the supporting piece of the supporting seat located in the plugging opening.

2. The DisplayPort having protection circuit according to claim 1, wherein the supporting seat is made of an insulating material.

3. The DisplayPort having protection circuit according to claim 1, wherein a gap is arranged between the sealing wall and the base plate.

4. The DisplayPort having protection circuit according to claim 1, wherein a projective pillar is supported and connected to a back face of the base plate.

5. The DisplayPort having protection circuit according to claim 1, wherein the connecting legs of the first terminal set are respectively shown as an "L" shape.

6. The DisplayPort having protection circuit according to claim 1, wherein the first terminal set consists of a plurality of connecting legs, each of which has a front connecting leg disposed in the groove of the supporting piece, and wherein a rear connecting leg is extended from a back side of the front connecting leg.

7. The DisplayPort having protection circuit according to claim 1, wherein one side of the circuit board has a plurality of perforations provided for the rear connecting legs on the connecting legs of the first terminal to be plugged therein.

8. The DisplayPort having protection circuit according to claim 1, wherein another side of the circuit board has a plurality of electrode perforations provided for the front connecting legs on the connecting legs of the second terminal to be electrically connected thereto.

9. The DisplayPort having protection circuit according to claim 1, wherein the protection element is a protection IC.

10. The DisplayPort having protection circuit according to claim 1, wherein the second terminal set consists of a plurality of connecting legs, each of which is shown as a stairs shape and is arranged a front connecting leg and a rear connecting leg, and wherein the front connecting legs are electrically connected to the electrode connecting legs of the circuit board.

11. The DisplayPort having protection circuit according to claim 1, wherein the bottom plate shown as an "L" configuration is made of an insulting material.

12. The DisplayPort having protection circuit according to claim 1 or 11, wherein a set of plate part arranged on the bottom plate is assembled to a bottom part of the supporting seat, and wherein one side of the plate part is bent into a stop part that is assembled to a rear opening of the supporting seat, in addition, a perforation arranged at a connecting place between the plate part and the stop part being provided for the rear connecting legs of the second terminal set to pass through.

13. The DisplayPort having protection circuit according to claim 1, wherein the outer casing is made of a metallic material.

14. The DisplayPort having protection circuit according to claim 1, wherein a plurality of arc stopping pieces are supported around an opening periphery of the plugging opening of the outer casing.

15. The DisplayPort having protection circuit according to claim 1, wherein end sides of a rear side and a side face of the hollow main body are respectively arranged a stop piece, while a set of connecting legs are extended from a bottom part of a side face of the main body.

16. The DisplayPort having protection circuit according to claim 1, wherein an end side of a bottom part of the plugging opening is inserted into a gap of the supporting seat.

* * * * *